US011095052B2

(12) United States Patent
Zhu

(10) Patent No.: US 11,095,052 B2
(45) Date of Patent: Aug. 17, 2021

(54) WIRING TERMINAL

(71) Applicant: Pinyou Zhu, Yueqing (CN)

(72) Inventor: Pinyou Zhu, Yueqing (CN)

( * ) Notice: Subject to any disclaimer, the term of this patent is extended or adjusted under 35 U.S.C. 154(b) by 0 days.

(21) Appl. No.: 16/709,732

(22) Filed: Dec. 10, 2019

(65) Prior Publication Data

US 2020/0185840 A1 Jun. 11, 2020

(30) Foreign Application Priority Data

Dec. 11, 2018 (CN) ..... 201811508098.6

(51) Int. Cl.
*H01R 4/48* (2006.01)
*H01R 9/24* (2006.01)

(52) U.S. Cl.
CPC ..... *H01R 4/4836* (2013.01); *H01R 4/4827* (2013.01); *H01R 9/2416* (2013.01)

(58) Field of Classification Search
CPC ..... H01R 4/4836
See application file for complete search history.

(56) References Cited

U.S. PATENT DOCUMENTS 6,851,967 B2 * 2/2005 Miyoshi ..... H01R 4/4836 439/441
9,847,587 B2 * 12/2017 Ludewig ..... H01R 9/223
2004/0152355 A1 8/2004 Rudy
2007/0207662 A1 9/2007 Germani
2016/0020543 A1 * 1/2016 Tedeschi ..... H01R 4/4845 439/733.1

FOREIGN PATENT DOCUMENTS

DE 10 2007 009 082 A1 9/2007

OTHER PUBLICATIONS

EP Search Report in Application No. 19215199.1 dated Apr. 9, 2020.

* cited by examiner

*Primary Examiner* — Ross N Gushi
(74) *Attorney, Agent, or Firm* — Maschoff Brennan

(57) ABSTRACT

Disclosed is a wiring terminal, which includes: a conductive member, an elastic piece and a handle; when the handle is in a first position, the elastic piece resists the conductive member under an acting of an elastic force; and when the handle moves from the first position to a second position along a sliding track, the handle acts on the elastic piece to deform the elastic piece, and separate from the conductive member to form a gap for facilitating a wire drawing or a wire plugging. Compared with the existing wiring terminal with a rotary wrench, a wiring terminal provided in the present embodiment may use a tool to drive a handle to move, which may effectively avoid the case where the wire is loosened due to the misoperation causing the open of the handle after the wire is connected.

12 Claims, 11 Drawing Sheets

WIRING TERMINAL

FIELD

The present disclosure relates to the field of electrical technology, and in particular to a wiring terminal.

BACKGROUND

A wiring terminal refers to an accessory product used to achieve the electrical connection. Two or more wires can be connected as needed through the wiring terminal without soldering or tangling them together, which is convenient and efficient.

In the prior art, there is a wiring terminal which mainly adopts an operation handle that is driven around a rotation axis, and an elastic piece in the wiring terminal is deformed or restored by pulling the operation handle, thereby controlling the gap size of the connection position to realize the access and teardown of the wire. Although these types of wiring terminals are convenient to use, there are cases where the wires of the operation handle are loosened due to misoperation of the operation handle after the wires are connected.

SUMMARY

In view of the deficiencies of the prior art, the technical problem to be solved or to be solved partly by the present disclosure is to provide a wiring terminal.

In order to solve the above technical problem, the present disclosure provides a wiring terminal. The wiring terminal includes: a conductive member, an elastic piece and a handle; when the handle is in a first position, the elastic piece resists the conductive member under an acting of an elastic force; and when the handle moves from the first position to a second position along a sliding track, the handle acts on the elastic piece to deform the elastic piece, and separate from the conductive member to form a gap for facilitating a wire drawing or a wire plugging.

Optionally, when the handle moves to the second position, an end surface of the handle applying an acting force to the elastic piece is a first inclined surface; an end surface of the elastic piece bearing the acting force is a second inclined surface; and the first inclined surface and the second inclined surface are matching fitted, to resist against an acting of an elastic restoring force and hold the handle at the second position.

Optionally, the handle conducts a plane sliding along the sliding track on a reference plane; and an angle formed between the first inclined surface and the reference plane is less than 10 degrees.

Optionally, the wiring terminal further includes a housing; a cavity for maintaining a position of the conductive member and a channel for the handle sliding therein are formed in the housing; and a portion of the handle is disposed within the housing, another portion extends outside the housing through the channel, and a tool jack is provided at an end exposed outside the housing.

Optionally, the housing has a front end surface, and another portion of the handle extends from the front end surface to the outside of the housing; the front end surface is a third inclined surface; and after a tool is inserted into the tool jack, a high point of the third inclined surface serves as an force applying fulcrum of the tool.

Optionally, a fourth inclined surface is provided at the high point of the third inclined surface with an angle with the third inclined surface; and after the tool is inserted into the tool jack, the fourth inclined surface is in contact with the tool, to serve as the force applying fulcrum of the tool.

Optionally, the conductive member includes two clamping portions, respectively a first clamping portion and a second clamping portion; the elastic piece includes two resisting portions, respectively a first resisting portion and a second resisting portion; the elastic piece is located between the two clamping portions, and the first resisting portion and the second resisting portion resist on the first clamping portion and the second clamping portion under the acting of the elastic force of the elastic piece, respectively.

Optionally, the first clamping portion and the second clamping portion are disposed substantially in parallel with each other.

Optionally, the conductive member further includes: a connecting portion, two sides of the connecting portion are respectively connected to the first clamping portion and the second clamping portion; where, an angle formed between the connecting portion and the first clamping portion is an obtuse angle, and an angle formed between the connecting portion and the second clamping portion is an acute angle.

Optionally, a position stopping protrusion is formed on the first clamping portion for stopping a sliding of the first resisting portion.

Optionally, a positioning hole is formed on the second clamping portion; a positioning protrusion is formed on the second resisting portion, when the second resisting portion resists on the second clamping portion, the positioning protrusion is embedded in the positioning hole, to fix a position of the second resisting portion with respect to the second clamping portion.

Optionally, the elastic piece further includes a spring portion connecting the first resisting portion and the second resisting portion, where, the spring portion is substantially formed as "U" shape.

Optionally, the handle includes: a slope portion, a slope surface matching with the first resisting portion is formed on the slope portion, and when the handle moves from the first position to the second position along the sliding track, the slope surface pushes the first resisting portion to separate the first resisting portion from the first clamping portion.

Optionally, a plurality of bends are formed on the first resisting portion from a location contacting the first clamping portion toward a direction away from the first clamping portion, and the slope surface matched with the bends.

Optionally, the handle further includes: a straight rod portion disposed along the sliding track and connected to the slope portion; a tool jack is provided on one side of the straight rod portion away from the slope portion.

Optionally, a blocking protrusion is provided on the straight rod portion; the blocking protrusion is blocked by the housing, to block the handle in a position between the first resisting portion and the first clamping portion.

According to the technical solution provided by the embodiment of the present disclosure, the handle may slide between the first position and the second position along the sliding track; when the handle slides to the first position, the elastic piece resists the conductive member; when the handle slides from the first position to the second position, the spring is deformed since the handle acts on the elastic piece, and the elastic piece is separated from the conductive member to form a gap for facilitating a wire drawing or a wire plugging. In practical applications, the wiring terminal provided in the present embodiment needs to use a tool to drive the handle to slide from the first position to the second position; compared with the existing wiring terminal with a rotary wrench, a wiring terminal provided in the present embodiment may use a tool to drive a handle to move, which may effectively avoid the case where the wire is loosened due to the misoperation causing the open of the handle after the wire is connected; and especially in the case where a repeated wire drawing or wire plugging is needed, the use of the tool is labor-saving, and the wiring staff's hands will not be painful due to the need to repeatedly pull the handle.

BRIEF DESCRIPTION OF THE DRAWINGS

In order to describe the technical solutions in the embodiments of the present disclosure or the prior art more clearly, the drawings required to be used for descriptions about the embodiments or the prior art will be simply introduced below. It is apparent that the drawings described below are some embodiments of the present disclosure. Those of ordinary skill in the art may further obtain other drawings according to these drawings without creative work.

DESCRIPTION OF THE REFERENCE SIGNS

1—conductive member; 11—first clamping portion; 111—position blocking protrusion; 12—second clamping portion; 121—positioning hole; 13—connecting portion; 131—yielding hole;

2—elastic piece; 21—first resisting portion; 211—first elastic bending surface; 212—second elastic bending surface; 213—third elastic bending surface; 22—second resisting portion; 221—positioning protrusion; 23—spring portion;

3—handle; 31—slope portion; 311—slope surface; 3111—first slope bending surface; 3112—second slope bending surface; 3113—third slope bending surface; 312—wire plugging hole; 32—straight rod portion; 321—sliding slot; 3220—blocking protrusion; 323—tool jack;

4—external wire;

5—housing; 51—sliding rail; 52—cover; 521—extension hole; 522—detection hole; 61—first inclined surface; 62—second inclined surface; 63—third inclined surface; 64—fourth inclined surface.

DETAILED DESCRIPTION OF EXAMPLE EMBODIMENTS

For making the purposes, technical solutions and advantages of the embodiments of the present invention clearer, the technical solutions in the embodiments of the present invention will be clearly and completely described below in combination with the drawings in the embodiments of the present invention. It is apparent that the described embodiments are not all embodiments but part of embodiments of the present invention. All other embodiments obtained by those of ordinary skill in the art on the basis of the embodiments in the present invention without creative work shall fall within the scope of protection of the present invention.

Figure 1:
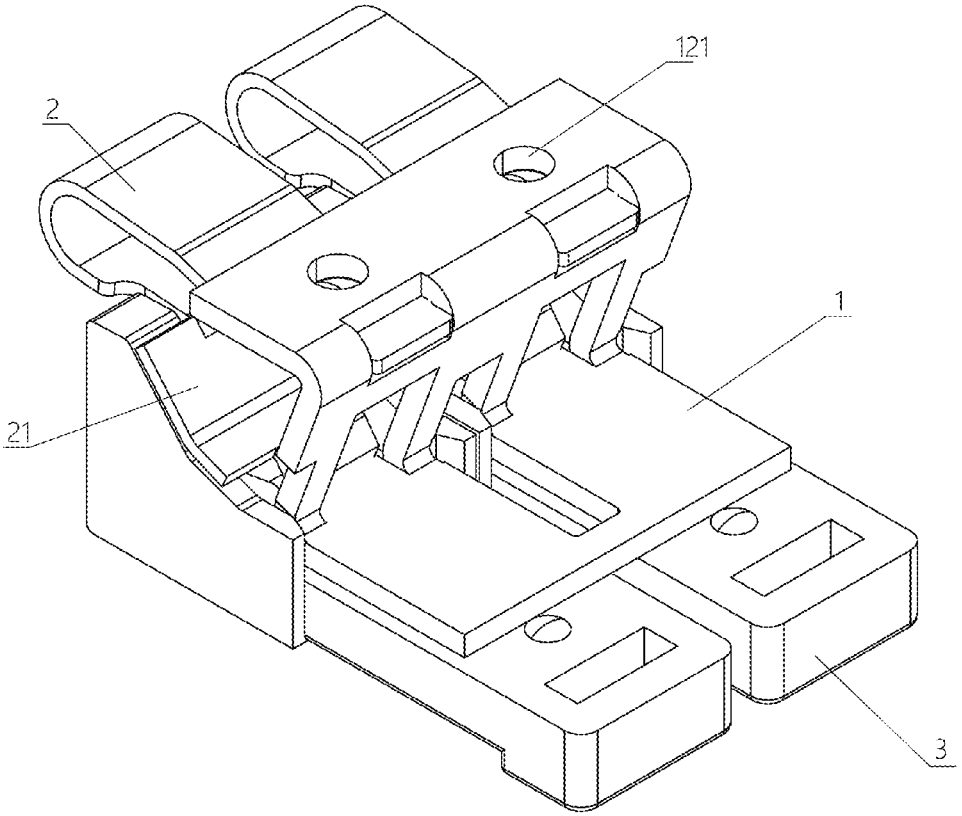
FIG. 1 is a perspective view showing a mutual combination of a conductive member, an elastic piece and a handle from a view observed by the conductive member when the wiring terminal is not connected to a wire according to an embodiment of the present disclosure.
Figure 2:
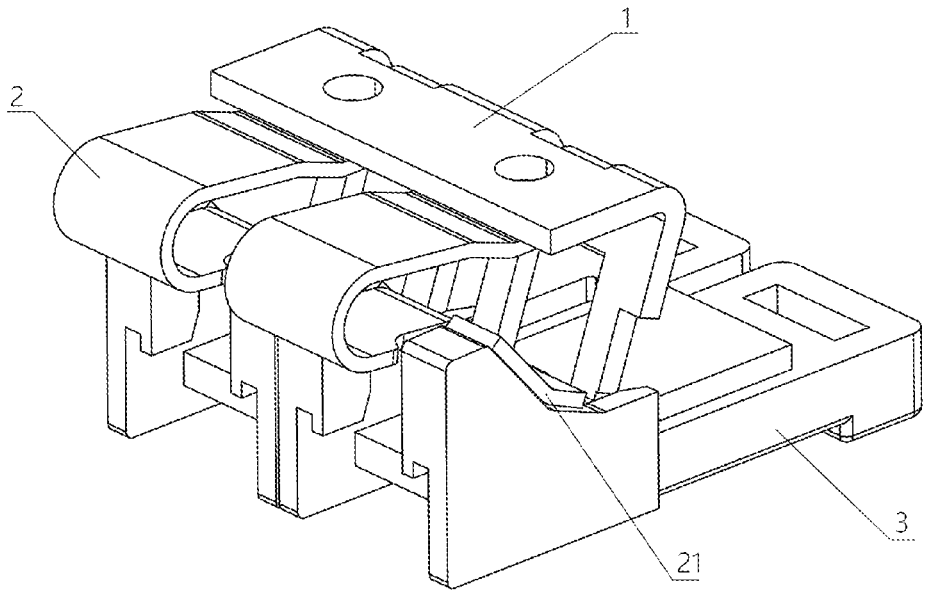
FIG. 2 is a perspective view showing a mutual combination of a conductive member, an elastic piece and a handle from a view observed by the elastic piece when the wiring terminal is not connected to a wire according to an embodiment of the present disclosure.
Figure 3:
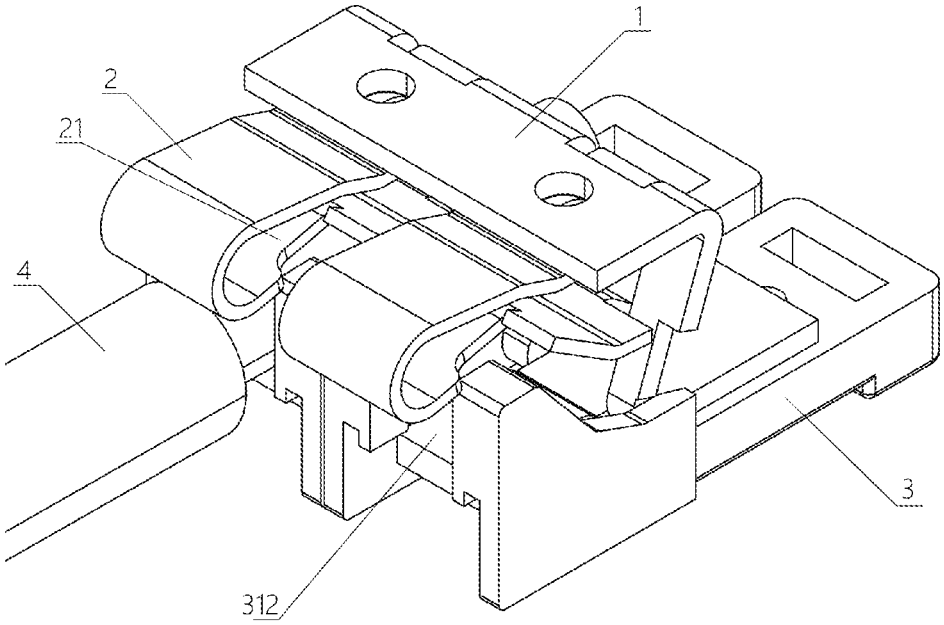
FIG. 3 is a perspective view showing a mutual combination of a conductive member, an elastic piece and a handle from a view observed by the elastic piece when the wiring terminal is connected to a wire according to an embodiment of the present disclosure.

In an embodiment of the present disclosure, as shown in FIG. 1 and FIG. 2, the wiring terminal includes: a conductive member 1, an elastic piece 2, and a handle 3. In FIGS. 1 and 2, the elastic piece 2 and the handle 3 are both in a natural state, and at this time, the external wire 4 is not inserted. At this time, the elastic piece resists the conductive member under an acting of the elastic force, and the handle is in a first position. As shown in FIG. 3, after the external wire 4 is inserted, the position of the handle 3 remains unchanged, and the external wire 4 pushes up the elastic piece 2 and is clamped between the elastic piece 2 and the conductive member 1; and the handle is also in the first position. Therefore, in the present embodiment, when the handle 3 is in the first position, the elastic piece 2 is resists the conductive member 1 under the acting of the elastic force. If the external wire is inserted, the external wire 4 is clamped between the conductive member 1 and the elastic piece 2 (i.e., the first resisting portion 21).

Figure 4:
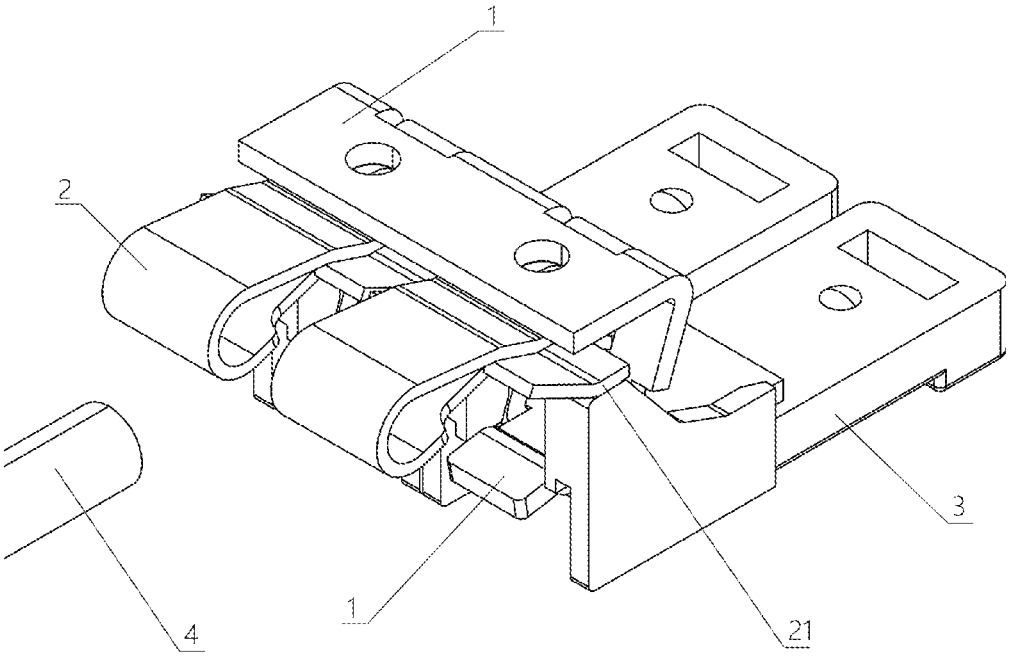
FIG. 4 is a perspective view showing a mutual combination of a conductive member, an elastic piece and a handle from a view observed by the elastic piece when the wiring terminal is took out from a wire according to an embodiment of the present disclosure.

As shown in FIG. 4, after the handle 3 is pushed or pulled, the handle 3 will simultaneously push the elastic piece 2. Defining the position of the handle 3 after the movement is the second position, that is, when the handle 3 moves from the first position to the second position along a sliding track, the handle 3 acts on the elastic piece 2 to deform the elastic piece 2, and the first resisting portion 21 separates from the conductive member 1 to form a gap for facilitating a wire drawing or a wire plugging.

In the technical solution provided by the present embodiment, the handle 3 is able to slide along the sliding track between the first position and the second position; when the handle 3 slides to the first position, the elastic piece 2 resists the conductive member 1; when the handle 3 slides from the first position to the second position, since the handle 3 acts on the elastic piece 2 to deform the elastic piece 2, the elastic piece 2 separates from the conductive member 1 to form a gap for facilitating s wire drawing or a wire plugging. In practical applications, the wiring terminal provided in the present embodiment needs to use a tool to drive the handle 3 to slide from the first position to the second position; compared with the existing wiring terminal with the operation handle, the wiring terminal provided in the present embodiment needs a tool to drive the handle to move, which may effectively avoid the case where the wire is loosened due to the misoperation causing the open of the handle after the wire is connected; especially in the case where a repeated wire drawing or wire plugging is needed, the use of the tool is labor-saving, and the wiring staff's hands will not be painful due to the need to repeatedly pull the handle.

In addition, in the present embodiment, it is only necessary to provide a sliding track for the handle in the wiring terminal to allow the handle 3 to slide along the sliding track, without setting the handle rotation structure generally available in the prior art, and also eliminating the need for positioning of the rotating shaft during installation. It not only simplifies the process, but also reduces the difficulty of installation, and helps to reduce the size of the wiring terminal to achieve a compact design.

Figure 5:
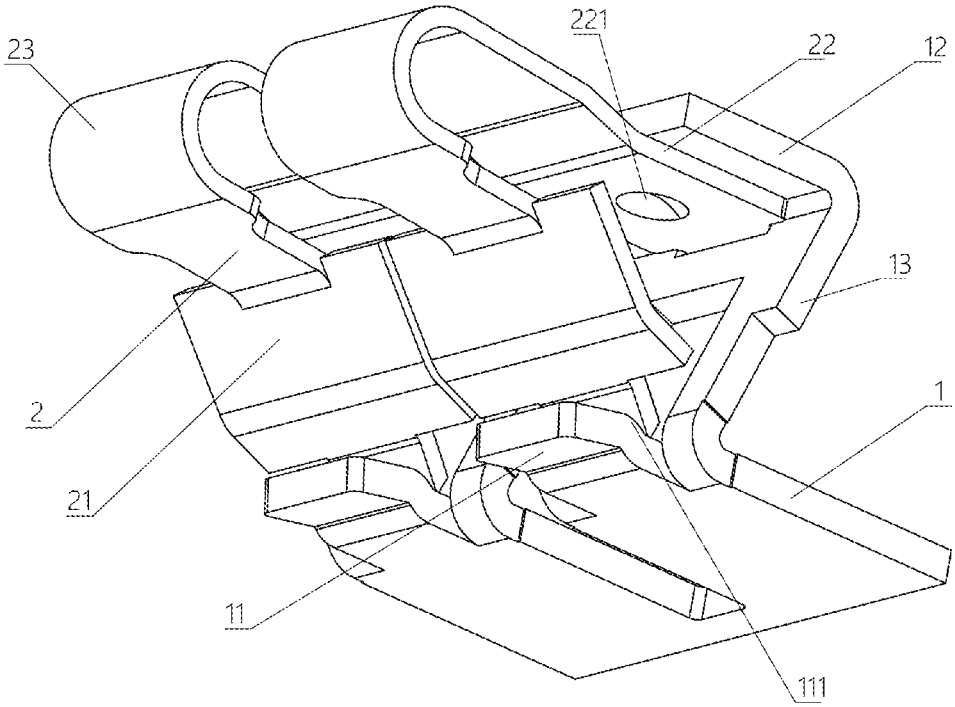
FIG. 5 is a perspective view showing a mutual connection of a conductive member and an elastic piece from a view observed by the elastic piece when the wiring terminal is not connected to a wire according to an embodiment of the present disclosure.

The conductive member 1 of the present embodiment may have various forms. As shown in FIG. 5, optionally, the conductive member 1 may include two clamping portions, which are a first clamping portion 11 and a second clamping portion 12 respectively; the elastic piece 2 includes two resisting portions, which are a first resisting portion 21 and a second resisting portion 22 respectively; the elastic piece 2 is located between the two clamping portions, and the first resisting portion 21 and the second resisting portion 22 are respectively resist on the clamping portion 11 and the second clamping portion 12 under the acting of an elastic force of the elastic piece 2.

Since the elastic piece 2 is elastic and the conductive member 1 is generally rigid, when the external wire 4 is pushed into the wiring terminal, the elastic piece 2 will be elastically deformed, so that the gap between the first resisting portion 21 and the first clamping portion 11 is enlarged until to it is sufficient to accommodate the external wire 4. When two clamping portions are respectively provided, there are two points of force, which may ensure that the elastic force of the elastic piece 2 is relatively balanced, so as to avoid the case where only one side of the elastic piece 2 is pressed and the other side is lifted, thereby uniformly the force untaken by the elastic piece 2.

Of course, even if two clamping portions are not provided, the technical purpose of the present disclosure may be substantially satisfied by using a similar structure. For example, the conductive member 1 and the elastic piece 2 may be integrally formed, and the second clamping portion 12 and the second resisting portion 22 are connected or merged together. For another example, the conductive member 1 may not adopt a cross-sectional shape similar to that of the "Z" as shown in FIG. 5, and may adopt other shapes of the "C", "E" or "F" that allow the wire to be connected.

In an achievable solution, the first clamping portion 11 and the second clamping portion 12 are disposed substantially parallel to each other. When the two are parallel to each other, the force of the elastic piece 2 may be well homogenized, and the elastic piece 2 can be protected to extend the service life thereof.

Further, as shown in FIG. 5, the conductive member 1 further includes: a connecting portion 13, two sides of the connecting portion 13 are respectively connected to the first clamping portion 11 and the second clamping portion 12. An angle formed between the connecting portion 13 and the first clamping portion 11 is an obtuse angle, and an angle formed between the connecting portion 13 and the second clamping portion 12 is an acute angle.

When the angle formed between the connecting portion 13 and the first clamping portion 11 is the obtuse angle, a large yielding space is formed between the connecting portion 13 and the first clamping portion 11 to prevent the connecting portion 13 from interference of the movement the first resisting portion 21 to allow the first resisting portion 21 of the elastic piece 2 to move more smoothly in this yielding space. The connecting portion 13 and the first clamping portion 11 or the second clamping portion 12 may also be provided with a smooth transition surface at the transition point therebetween, and the provided transition surface may further provide a yielding space to avoid interference between devices.

Figure 6:
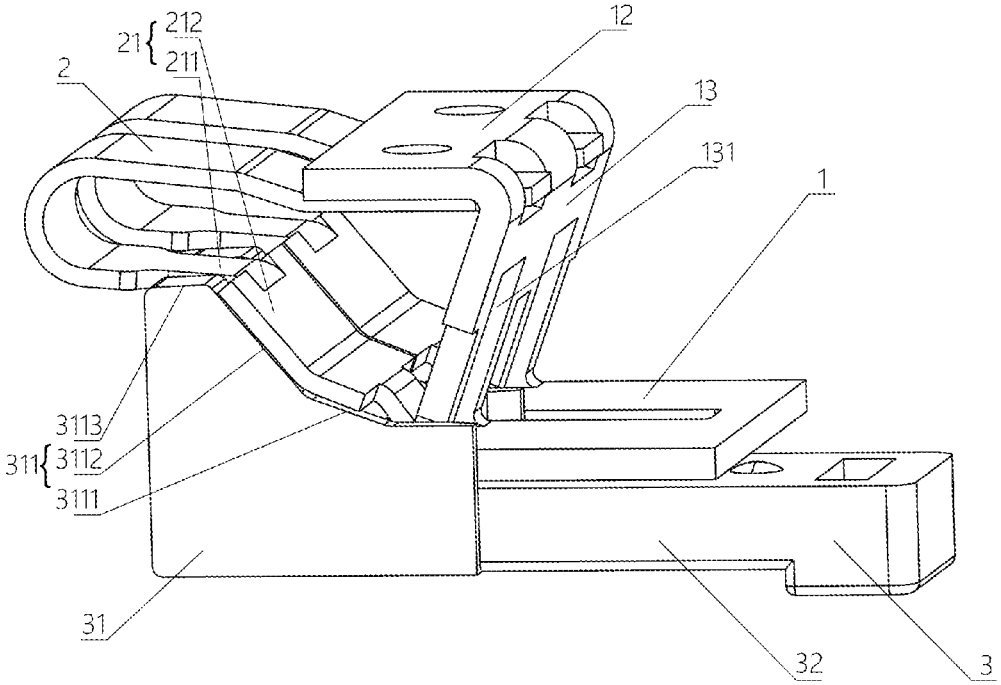
FIG. 6 is a perspective view showing a mutual connection of a conductive member, an elastic piece and a handle observed from a side when the wiring terminal is not connected to a wire according to an embodiment of the present disclosure.

Further, as shown in FIG. 6, it is also possible to provide a yielding hole 131 on the connecting portion 13 to yield the movement of the first resisting portions 21, and thereby further preventing interference. The yielding hole 131 may also serve as a technical effect for conserving the material of the conductive member 1. Moreover, the sufficient yielding space allows the wiring terminal to be capable of operating in a thermal expansion and contraction environment and has a wide range of applications.

In an achievable technical solution, as shown in FIG. 1, a positioning hole 121 may be formed on the second clamping portion 12; as shown in FIG. 5, a positioning protrusion 221 may be formed on the second resisting portion 22. When the second resisting portion 22 resists the second clamping portion 12, the positioning protrusion 221 is fitted into the positioning hole 121 to fix the position of the second resisting portion 22 relative to the second clamping portion 12. Since the contact area of the second clamping portion 12 and the second resisting portion 22 is usually small in consideration of the miniaturization design of the wiring terminal in practical use, when the elastic piece 2 is pressed to the extreme position, the surfaces of the second resisting portion 22 and the second clamping portion 12 may be slipped relative to each other, due to the large elastic force brought about by the second elastic force. Therefore, by inserting the positioning protrusion 221 into the positioning hole 121 and fixing the relative positions of the two, slippage that may occur can be prevented, so that the reciprocating deformation movement of the elastic piece 2 is more stable.

Alternatively, as shown in FIG. 5, the first clamping portion 11 may be formed with a position blocking protrusion 111 for stopping the sliding of the first resisting portion 21. When the positions of the second clamping portion 12 and the second resisting portion 22 are relatively fixed, the first resisting portion 21 necessarily intends to move in a direction away from the second resisting portion 22 under the elastic force of the spring. For the same reason, the contact area of the first resisting portion 21 and the first clamping portion 11 is also small, and is smaller than the contact area of the second resisting portion 22 and the second absorbing portion 12 for large probability. At this time, if the external wire 4 is released, there is a possibility that the first resisting portion 21 slips and deviates from the restriction of the first clamping portion 11. In the embodiment of the present disclosure, comparing to relaying on the frictional force to prevent the sliding of the first resisting portion 21 only, the resisting portion 21 is blocked by the position blocking protrusion 111, the position stopping and limiting acts well therefore, and the amplitude and stability of the elastic piece 2 can be guaranteed.

In addition, optionally, as shown in FIG. 5, the elastic piece 2 further includes a spring portion 23 connecting the first resisting portion 21 and the second resisting portion 22, and the spring portion 23 is formed substantially in a "U" shape. The spring portion 23 formed in a "U" shape has a smooth transition comparing to the "V" shape or other similar shapes. When pressure is applied, the pressure will be evenly distributed in the "U" shaped arcuate section, so the elastic piece 2 will have better elastic deformation and longer life.

In addition, in an achievable technical solution, as shown in FIG. 6, the handle 3 may include a slop portion 31 formed with a slope surface 311 matching the first resisting portion 21. When the handle 3 slides from the first position to the second position along the sliding track, the slope surface 311 pushes the first resisting portion 21 to separate the first resisting portion 21 from the first clamping portion 11.

In the present disclosure, the handle 3 may be triggered to trigger the movement of the first resisting portion 21 in a number of ways. For example, the first resisting portion 21 can be dragged by the handle 3 to cause movement. However, in contrast, when the first resisting portion 21 is pushed by the slope surface 311 of the handle 3, it is not necessary to provide a mechanism for converting the direction of the force, so that the structure of the wiring terminal can be remarkably simplified, and the cost can be reduced. Further, when the handle 3 is in the first position, the attaching area of the handle 3 and the first resisting portion 21 is large, so that the force applied to the elastic piece 2 is relatively uniform, and the elastic piece 2 can be prevented from being deteriorated due to stress concentration at a specific portion.

Figure 7:
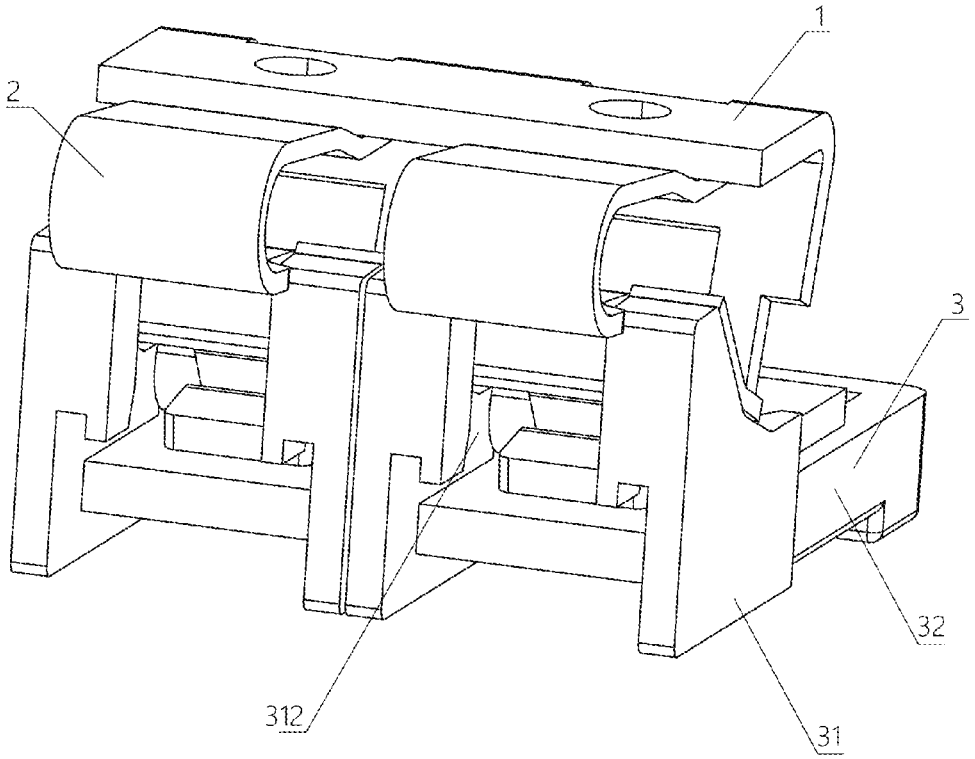
FIG. 7 is a perspective view showing a mutual combination of a conductive member, an elastic piece and a handle from a view observed by the handle and the elastic piece when the wiring terminal is not connected to a wire according to an embodiment of the present disclosure.

It is to be noted that, as shown in FIG. 7, along the sliding direction of the handle 3, the slope portion 31 is formed with a wire plugging hole 312 penetrating the slope surface 311 for the insertion of the external wire 4. The wire plugging hole 312 is provided with a position for the external wire 4, so that the structure of the wiring terminal is more reasonable, and the metal material on the elastic piece 2 can be saved.

Further, alternatively, as shown in FIG. 6, the first resisting portion 21 may be formed with a plurality of bends from a location contacting the first clamping portion 11 toward a direction away from the first clamping portion 11, and the slope surface 311 matched with the bends. The designed plurality of bends can realize the control of the movement amplitude and the movement trajectory of the first abutting portion 21. In addition, since there are a plurality of bends, the elastic piece 2 can be controlled from the first position to the second position of the handle 3 by changing the inclination of the bends, or the change in the force of the elastic piece 2 during the process of the handle 3 from the second position to the first position. Further, the purpose of extending the life of the elastic piece 2 is achieved.

For example, as shown in FIG. 6, the slope surface 311 is provided with a first slope bending surface 3111, a second slope bending surface 3112, and a slope bending surface 3113 . . . a nth slope bending surface and so successively in a direction from a location closing to the conductive member 1 to a location away from the conductive member 1. The first slope bending surface 3111 has a first bending angle with respect to the moving direction of the handle 3 on the sliding track, and the second slope bending surface 3112 has a second bending angle with respect to the moving direction of the handle 3 on the sliding track. The second bending angle may be greater than the first bending angle, that is, the folding angle of the second slope bending surface 3112 is greater than the first slope bending surface 3111 thereof, i.e. more steep. In addition, the final slope bending surface may be made substantially parallel to the moving direction of the handle 3 to form a platform for propping up the elastic piece 2.

At the same time, the first resisting portion 21 is provided with a first elastic bending surface 211, a second elastic bending surface 212, . . . an nth elastic bending surface in a direction from a location away from the conductive member 1 to a direction close to the conductive member 1.

During the advancement of the slope surface 311 toward the first resisting portion 21, the last slope bending surface and the first elastic bending surface 211 will be first separated. During the process, the slope surface 311 will sequentially push up the respective bending surfaces of the first resisting portion 21 along the contour of the first resisting portion 21 until the handle 3 reaches the second position.

That is to say, the conversion of the force direction of the first resisting portion 21 is achieved only by the simple bevel transmission according to the present embodiment. The operation of flipping and toggling is greatly simplified as the operation of a linear motion operation of the handle 3, and the convenience is greatly improved thereby.

Figure 8:
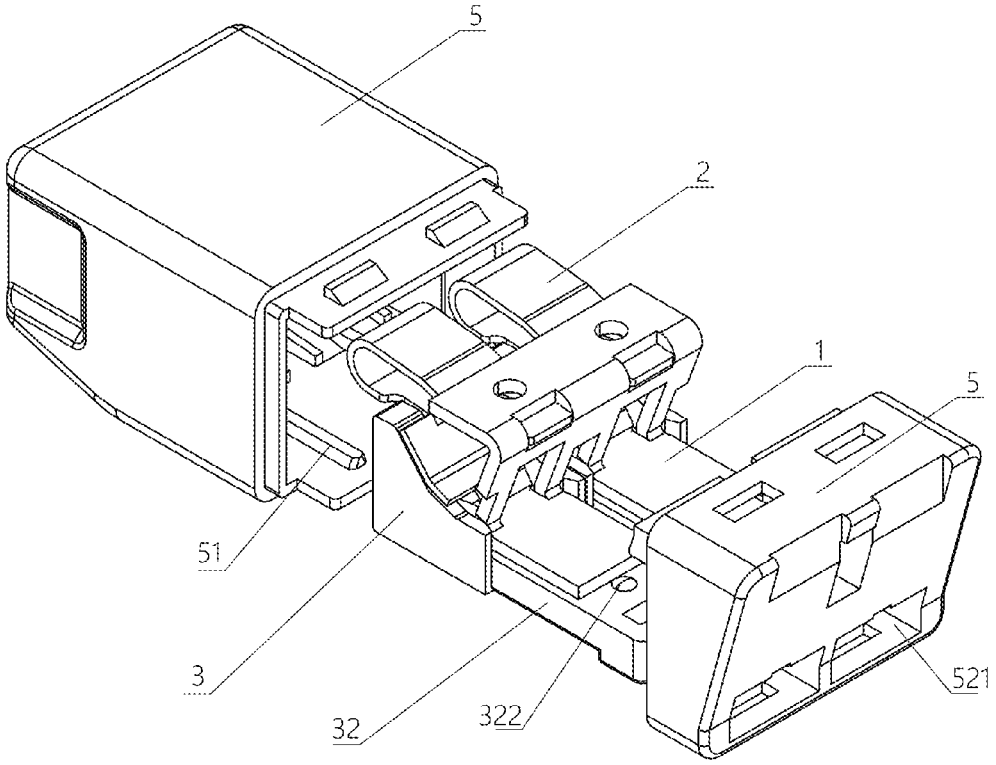
FIG. 8 is a schematic view showing an isometric explosion of a wiring terminal in a plan view according to an embodiment of the present disclosure.
Figure 9:
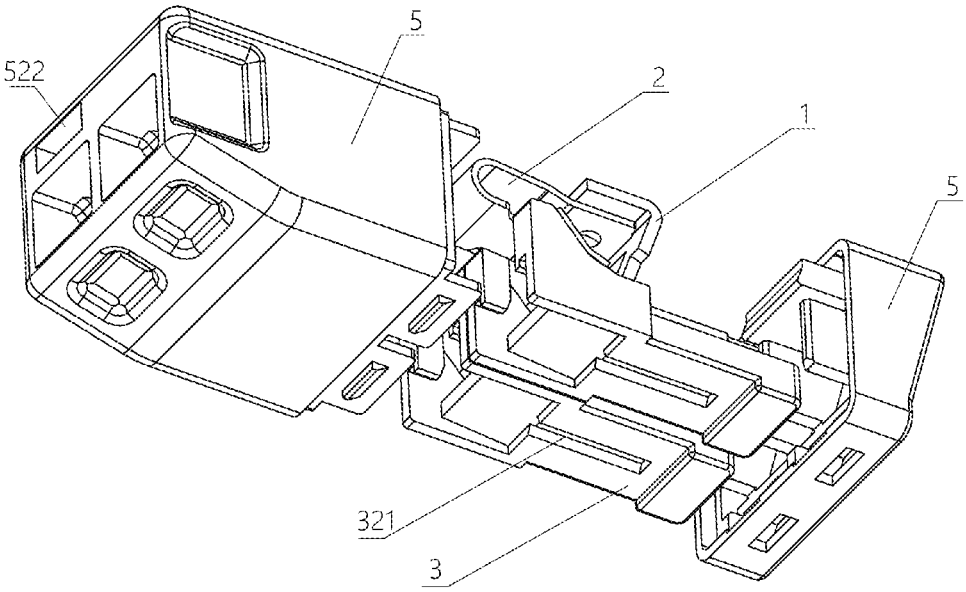
FIG. 9 is a schematic view showing an isometric explosion of a wiring terminal in an upward view according to an embodiment of the present disclosure.
Figure 10:
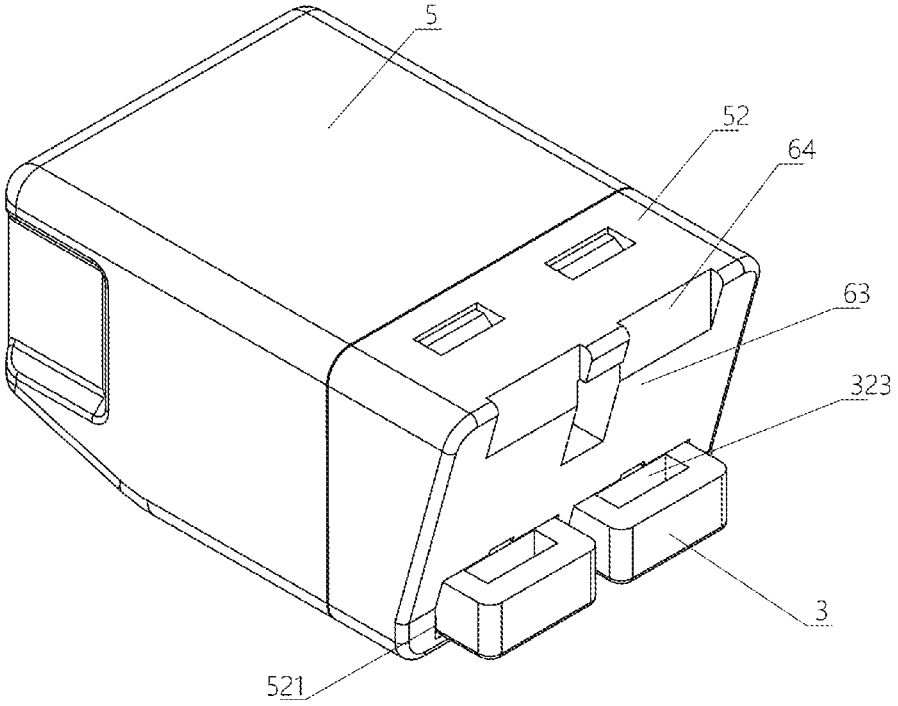
FIG. 10 is a perspective view showing an external form of a wiring terminal according to an embodiment of the present disclosure.

In an achievable technical solution, as shown in FIG. 8, FIG. 9, FIG. 10, a cavity for maintaining the position of the conductive member 1 and a channel for the handle 3 sliding therein are formed in the housing 5. A portion of handle 3 is disposed within the housing 5, and another portion extends outside the housing 5 through the channel, and a tool jack 323 is provided at an end exposed outside the housing 5.

Where, the housing 5 has a front end surface, and another portion of the handle 5 extends from the front end surface to the outside of the housing; the front end surface is a third inclined surface 63; and after a tool is inserted into the tool jack 323, a high point of the third inclined surface 63 serves as a force applying fulcrum of the tool.

A fourth inclined surface 64 provided at the high point of the third inclined surface 63 with an angle with the third inclined surface 63;

After the tool is inserted into the tool jack 323, the fourth inclined surface 64 is in contact with the tool, to serve as the force applying fulcrum of the tool.

Specifically, the handle 3 may further include a straight rod portion 32 disposed along the sliding track and connected to the slope portion 31; and a tool jack 323 is provided on one side of the straight rod portion 32 away from the slope portion 31.

When the handle adopts a structure including the slope portion and the straight rod portion, the portion of the handle 3 described above that is placed in the cavity refers to a portion of the slope portion 31 and the straight rod portion 32; and another portion that extends outside the housing 5 refers to a head end of the straight rod portion 32.

The straight rod portion 32 can ensure the stable movement of the handle 3 along the sliding track. Specifically, the sliding track may be a linear track to further improve the operational convenience.

As shown in FIG. 8, a sliding rail 51 may be formed in the channel. As shown in FIG. 9, the straight rod portion 32 may be formed with a sliding slot 321 that cooperates with the sliding rail 51.

Of course, the sliding slot 321 and the sliding rail 51 can also be exchanged to each other, or other similar functional structures, such as a guide wheel, a guide belt or the like, for replacement. In contrast, the combination of the sliding slot 321 and the sliding rail 51 has the advantages of simple manufacture and low cost.

Further, it is worth mentioning that when the housing 5 is provided, a through hole may be formed in the position of the housing 5 corresponding to the wire plugging hole 312 for the external wire 4 to be inserted. Further, the inner surface of the housing 5 may be provided with some reinforcing ribs to reinforce the structural strength of the housing 5.

In addition, in an achievable technical solution, as shown in FIG. 8, the straight rod portion 32 is further provided with a blocking protrusion 322; the blocking protrusion 322 can be blocked by the housing 5 for blocking the handle 3 located at the position where the first resisting portion 21 is separated from the first clamping portion 11, that is, the first position. Specifically, a blocking groove matching the blocking protrusion 322 may be disposed on the housing 5. Of course, the corresponding structure may not be provided, and only relying on the friction between the housing 5 and the blocking protrusion 322 is sufficient to block the movement tendency of the handle 3.

When the straight rod portion 32 is pushed to the first position, the external wire 4 can be taken out. At this time, due to the elastic force of the elastic piece 2, the straight rod portion 32 will tend to move toward the second position. The blocking protrusion 322 is provided to block this movement tendency, so that the handle 3 can maintain the elastic piece 2 in a compressed state, thereby making the operation of releasing the external wire 4 more convenient.

In an achievable technical solution, as shown in FIG. 10, the mentioned tool jack 323 is disposed on a side of the straight rod portion 32 away from the slope surface 311; the housing 5 further includes a cover 52, the front end surface is located on the cover 52. The cover 52 is formed with an extension hole 521 through which the straight rod portion 32 passes. The straight rod portion 32 passes through the extension hole 521 to expose the tool jack 323 to the outside of the housing 5.

By extending the straight rod portion 32 of the cover 52, the first resisting portion 21 of the elastic piece 2 can be easily separated from the first clamping portion 11 of the conductive member 1 by the handle 3 by simply pulling the tool jack 323 with a screwdriver or some simple tool. Therefore, it has the advantages of labor saving, convenience and safety.

Still further, still as shown in FIG. 10, on the side of the cover 52 where the protruding hole 521 is formed, that is, the front end surface, the side away from the protruding hole 521 outwardly convex in relative to the lateral direction of the protruding hole 521. The protruding part can be used as the fulcrum of the tool, which is convenient for the tool to perform the toggle operation, which is more labor-saving and convenient.

The surface of the cover 52 forming the extension hole 521, that is, the front end face itself may be formed as a third inclined surface 63 which is inclined with respect to the moving direction of the handle 3. Of course, it is also possible to additionally add a third inclined surface 63 above the surface of the cover 52 forming the protruding hole 521. In relative to the plane perpendicular to the moving direction of the handle 3, the provided inclined surface can better serve as a fulcrum.

Further, on the surface of the cover 52 where the extension hole 521 is formed, a fourth inclined surface is provided with an angle with the third inclined surface at a convex portion which extends outward. The fourth inclined surface 64 can be directly in contact with the tool to enhance the hand feeling. Moreover, the provided inclined surface can effectively prevent the can effectively prevent the wear of the housing 5 and improve the durability as compared with providing a sharp corner.

In addition to this, as shown in FIG. 9, the housing 5 is further provided with a detection hole 522. The provided detection hole 522 can detect the health state of the internal device when the housing 5 is not opened, and the convenience is improved thereby.

It is worth mentioning that in order to realize the contact and connection between the plurality of external wires 4, a corresponding plurality of features may be provided in each of the conductive members 1 and the elastic sheets 2. Taking FIG. 1 of the present disclosure as an example, in one wiring terminal, one conductive member 1 is provided with two first clamping portions 11 and two second clamping portions 12 side by side, and is electrically connected uniformly. It can be understood that the number of the first resisting portion 21 and the second resisting portion 22 of the elastic piece 2 will be the same and one-to-one correspondence. It is also possible to set three, five or even more identical features. A plurality of components may be repeated along a straight line array, or may be repeated in an array on a plane, which does not affect the technical purpose of the present disclosure.

The embodiment of the present disclosure also provides a feasible operation procedure of wiring and taking out the wiring terminal, as follows:

1. When the external wire 4 is not inserted, the wiring terminal is in a natural state. At this time, the internal structure can be seen in FIG. 1, FIG. 2, and FIG. 6. The handle 3 is in the first position. The second clamping portion 12 of the conductive member 1 and the first resisting portion 21 of the elastic piece 2 are in close contact with each other.

2. As shown in FIG. 3, the external wire 4 is inserted into the wiring terminal through the through hole in the housing 5 and the wire plugging hole 312 in the handle 3. Under the resisting and pushing of the external wire 4, the first resisting portion 21 of the elastic piece 2 will be lifted up.

Under the acting of the restoring force of the elastic piece 2, in particular, the restoring force provided by the "U"-shaped structure of the spring portion 23, the first resisting portion 21 securely fastens the external wire 4 between the first resisting portion 21 and the first clamping portion 11. Accordingly, the external wire 4 can be accessed by a simple insertion action.

3. When the external wire 4 needs to be taken out. The locking state of the wiring terminal can be opened by operating the handle 3. As shown in FIGS. 8, 9, and 10, a screwdriver, particularly a slotted screwdriver, can be used to pluck the tool jack on the handle 3 with the fourth inclined surface 64 on the housing 5 as a fulcrum, allowing the handle 3 to move from the first position to the second position along the sliding track provided by the sliding slot 321 and the sliding rail 51.

During the movement of the handle 3, as shown in FIG. 4, the slope surface 311 on the slope portion 31 of the handle 3 will resist and further push the first resisting portion 21 until the handle 3 is in the second position.

When the handle 3 is in the second position, the blocking protrusion 322 on the handle 3 will create a frictional resistance with the housing 5. This frictional resistance will prevent the handle 3 from returning, thereby preventing the return of the first resisting portion 21.

Since the first resisting portion 21 and the first clamping portion 11 are already in a separated state, the external wire 4 can be easily taken out and released.

4. After the external wire 4 is removed, the handle 3 can be pushed back from the second position back to the first position. At this time, the elastic potential energy of the spring portion 23 of the elastic piece 2 is released, and the first resisting portion 21 will return to the initial position under the restriction of the position blocking protrusion 111 of the conductive member 1, that is, the position in the natural state, and wait the next access of the external conductor 4 is made.

It can be seen that compared with the prior art, the wiring terminal of the present disclosure has a stronger advantage in terms of ease of use, convenience, reusability, service life, manufacturing cost and maintenance cost, and has good economic prospects.

As a further embodiment of the present disclosure, a wiring terminal is also provided. Its wiring terminal also includes:

a conductive member 1, an elastic piece 2 and a handle 3. The basic structure is similar to that of the previous embodiment. Specifically, in FIGS. 1, 2, and 12, the elastic piece 2 and the handle 3 are both in a natural state, and at this time, the external wire 4 is not inserted.

As shown in FIG. 3, after the external wire 4 is inserted, the position of the handle 3 remains unchanged, and the external wire 4 pushes up the elastic piece 2. Defining the handle 3 in this position is the first position, that is, in the present disclosure, when the handle 3 is in the first position, the first resisting portion 21 of the elastic piece 2 resists the elastic member 1 under an acting of the elastic force, so that the external wire 4 is sandwiched between the conductive member 1 and the first resisting portion 21.

Figure 11:
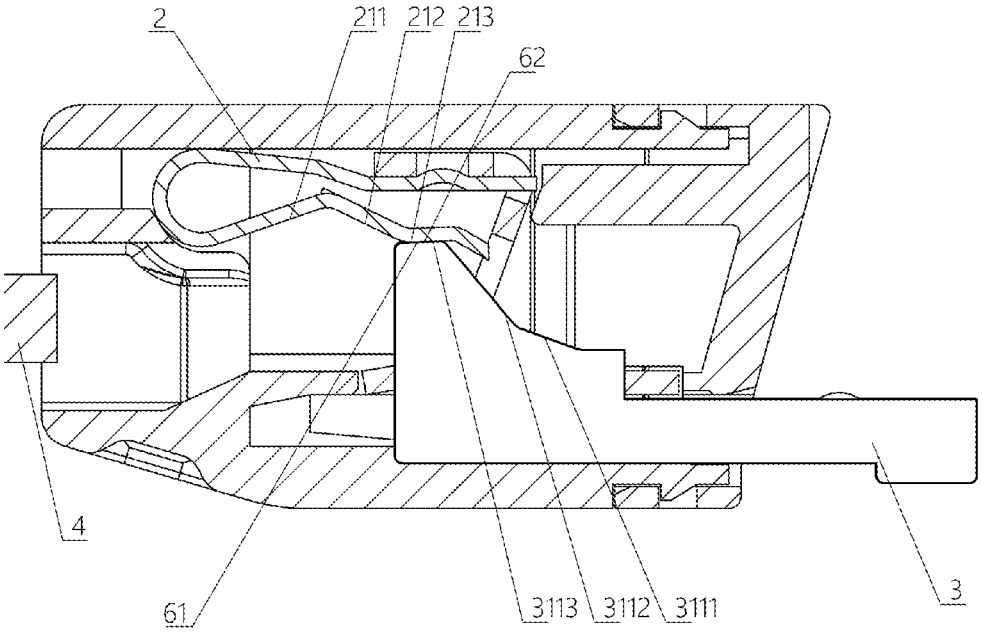
FIG. 11 is a perspective view showing a sectional structure when a wiring terminal is took out from a wire according to an embodiment of the present disclosure.

As shown in FIG. 4 and FIG. 11, after the handle 3 is pushed or pulled, the handle 3 will simultaneously push the elastic piece 2. Defining the position of the handle 3 after the movement is the second position, that is, when the handle 3 moves from the first position to the second position along the sliding track, the handle 3 acts on the elastic piece 2 to deform the elastic piece 2, first resisting portion 21 is separated from the conductive member 1 to facilitate the release of the external wire 4.

Figure 12:
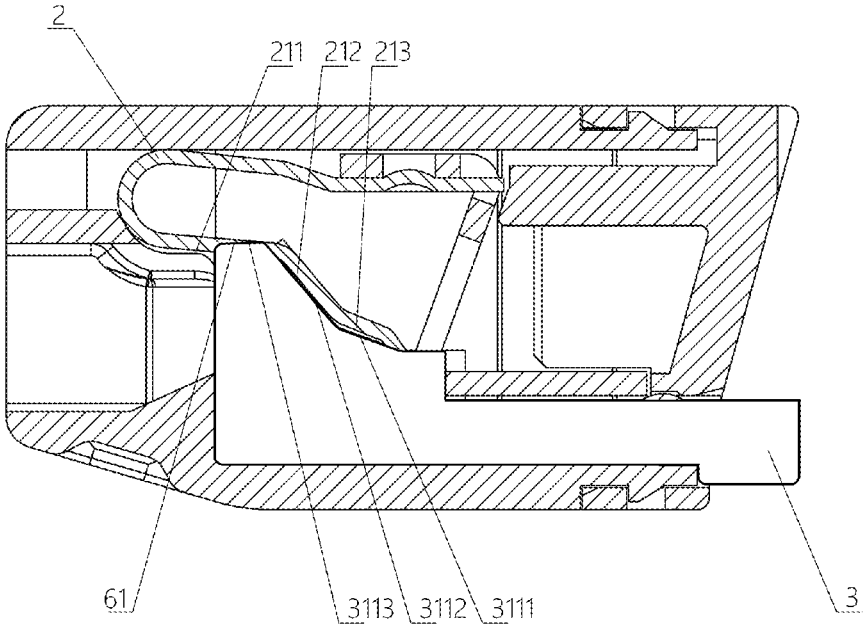
FIG. 12 is a perspective view showing a sectional structure when a wiring terminal is not connected to a wire according to an embodiment of the present disclosure.

As a further improvement of the previous embodiment, in the present embodiment, as shown in FIG. 11 and FIG. 12, when the handle 3 moves to the second position, the end surface of the handle 3 that exerts a force on the elastic piece 2 is defined as the first inclined surface 61. The end surface that receives the force is defined as the second inclined surface 62. The first inclined surface 61 and the second inclined surface 62 are matched and fitted to hold the handle 3 at the second position by the action of the elastic restoring force.

When the slope surface 311 is provided with a plurality of slope bending surfaces successively in the direction from a location closing to the conductive member 1 to a location away from the conductive member 1, the last slope bending surface is the first inclined surface 61. As shown in FIGS. 11 and 12, the third slope bending surface 3113 is the indicated first inclined surface 61.

When the first resisting portion 21 is provided with a plurality of elastic bending surfaces successively in the direction from a location closing to the conductive member 1 to a location away from the conductive member 1, a first elastic bending surface that is bent in a direction away from the slope surface 311 with respect to the previous elastic bending surface is defined as the second inclined surface. As shown in FIG. 11 and FIG. 12, the third elastic bending surface 213 is the indicated second inclined surface 62.

When the slope surface 311 is provided with a plurality of slope bending surfaces successively in the direction from a location closing to the conductive member 1 to a location away from the conductive member 1, the slope bending surface formed as the first inclined surface 61 (that is, the third slope bending surface 3113 shown in FIGS. 11 and 12) may bend in a direction away from the first resisting portion 21 with respect to the previous slope bending surface (that is, the second slope bending surface 3112 shown in FIGS. 11 and 12), so that a convex portion in a direction toward the first resisting portion 21 is formed between the first inclined surface 61 and the previous slope bending surface.

At the same time, when the first resisting portion 21 is provided with a plurality of elastic bending surfaces successively in the direction from a location closing to the conductive member 1 to a location away from the conductive member 1, the elastic bending surface formed as the second inclined surface 62 (that is, the third elastic bending surface 213 shown in FIGS. 11 and 12) may bend in a direction away from the slope surface 311 with respect to the previous elastic bending surface (that is, second elastic bending surface 212 shown in FIGS. 11 and 12), so that a convex portion in a direction toward the slope surface 311 is formed between the second inclined surface 62 and the previous elastic bending surface.

Under the acting of the elastic force of the elastic piece 2 itself, the elastic piece 2 always has a tendency to move toward the slope surface 311, so that the two convex portions are mutually hindered, thereby facilitating the matching of the first inclined surface and the second inclined surface, acting as an elastic recovery force of the impedance.

That is to say, the present embodiment realizes the self-locking of the relative positions of the elastic piece 2 and the handle 3 by controlling the bending angle of the contact surface between the handle 3 and the elastic piece 2.

In the previous embodiment, the straight rod portion 32 is provided with a blocking protrusion 322; the blocking protrusion 322 can be blocked by the housing 5 for blocking the handle 3 at the position where the first resisting portion 21 and the first clamping portion 11 is separated, that is, the first position. Since the blocking protrusion 322 is disposed on the handle 3, repeated friction with the outer housing during long-term use may cause wear and affect the service life.

In the present embodiment, the elastic piece 2 is self-locked directly by the inclined structure of the elastic piece 2 itself. Since the blocking is not achieved by friction, but by the elastic force, there is no need to consider the wear problem and prolong the service life.

Of course, it is also possible to provide the first inclined surface 61, the second inclined surface 62 and the blocking protrusion 322 at the same time, which has a double self-locking and reset blocking effect.

It is particularly worth mentioning that in the present embodiment, the third slope bending surface 3113 is the first inclined surface 61, and the third elastic bending surface 213 is the second inclined surface 62 as an example. However, in the actual use process, the bending condition of the slope surface 311 and the first resisting portion 21 may be different, and according to the actual bending condition, the slope bending surface or the elastic bending surface corresponding to the first inclined surface 61 or the second inclined surface 62 may also be different (may also be the fourth slope bending surface or the fifth elastic bending surface, etc.), and these changes do not affect the realization of the purpose of the technology of the present disclosure.

Further, optionally, when the handle 3 slides along the sliding track on the reference plane, the angle between the first inclined surface 61 and the reference plane, that is, the moving direction of the handle 3, may be less than 10 degrees. When the first inclined surface 61 is the third slope bending surface 3113, it can be considered that the angle of the third slope bending surface 3113 with respect to the moving direction of the handle 3 is less than 10 degrees.

Through the experiments and calculations of the inventors of the present disclosure, it is found that when the angle of less than 10 degrees, especially the angle of less than 5 degrees, preferably 2 degrees, the self-locking force is moderate, the handle 3 can be ensured to advance and retreat.

The embodiment of the present disclosure also provides a feasible operation process of wiring and taking out the wiring terminal, as follows:

1. When the external wire 4 is not inserted, the wiring terminal is in a natural state. At this time, the internal structure can be seen in FIG. 1, FIG. 2, and FIG. 6. The handle 3 is in the first position. The second clamping portion 12 of the conductive member 1 and the first resisting portion 21 of the elastic piece 2 are in close contact with each other. Specifically, as shown in FIG. 12, the first slope bending surface 3111 on the handle 3 is in contact with the third elastic bending surface 213 on the elastic piece 2; the second slope bending surface 3112 on the handle 3 is in contact with the second elastic bending surface 212; and the third slope bending surface 3113 on the handle 3 is in contact with the first elastic bending surface 211 on the elastic piece 2.

2. As shown in FIG. 3, the external wire 4 is inserted into the wiring terminal through the through hole in the housing 5 and the wire plugging hole 312 in the handle 3. Under the resisting and pushing of the external wire 4, the first resisting portion 21 of the elastic piece 2 will be lifted up, with contacting the handle 3.

Under the acting of the restoring force of the elastic piece 2, in particular, the restoring force provided by the "U"-shaped structure of the spring portion 23, the first resisting portion 21 securely fastens the external wire 4 between the first resisting portion 21 and the first clamping portion 11. Accordingly, the external wire 4 can be accessed by a simple insertion action.

3. When the external wire 4 needs to be taken out. The locking state of the wiring terminal can be opened by operating the handle 3. As shown in FIGS. 8, 9, and 10, a screwdriver, particularly a slotted screwdriver, can be used to pluck the tool jack on the handle 3 with the fourth inclined surface 64 on the housing 5 as a fulcrum, allowing the handle 3 to move from the first position to the second position along the sliding track provided by the sliding slot 321 and the sliding rail 51.

During the movement of the handle 3, as shown in FIG. 11, the slope surface 311 on the slope portion 31 of the handle 3 will resist and push the first resisting portion 21 until the handle 3 is in the second position. During this process, the convex portion formed between the second slope bending surface 3112 and the third slope bending surface 3113 on the handle 3 will sequentially push up the first elastic bending surface 211 and the second elastic bending surface 212 on the elastic piece 2. After the convex portion formed between the second elastic bending surface 212 and the third elastic bending surface 213 is passed, the third slope bending surface 3113 and the third elastic bending surface 213 are fitted. The third slope bending surface 3113 and the third elastic bending surface 213 are realized, and the first inclined surface 61 and the second inclined surface 62 are mutually self-locking.

According to this, when the handle 3 is in the second position, the elastic restoring force of the elastic piece 2 is blocked under the interaction of the first inclined surface 61 and the second inclined surface 62, and thus the first resisting portion 21 can be prevented being reset. Since the first resisting portion 21 and the first clamping portion 11 are already in a separated state, the external wire 4 can be taken out and released without any hindrance.

4. After the external wire 4 is removed, the handle 3 can be pushed back from the second position back to the first position. At this time, the elastic potential energy of the spring portion 23 of the elastic piece 2 is released, and the first resisting portion 21 will return to the initial position under the restriction of the position blocking protrusion 111 of the conductive member 1, that is, the position in the natural state, and wait the next access of the external conductor 4 is made.

It can be seen that compared with the prior art, the wiring terminal of the present disclosure has a stronger advantage in terms of ease of use, convenience, reusability, service life, manufacturing cost and maintenance cost, and has good economic prospects.

It is to be understood that term used in the embodiments of the present disclosure is for the purpose for descripting the specific embodiments, rather than limiting the present application. The singular forms "a", "an", "the" and "said" used in the embodiments of the present application and the appended claims also include multiple forms. Generally, "multiple" includes at least two unless the context clearly indicates other meanings, but does not exclude the situation of including at least one.

It is to be understood that term "and/or" used in the present disclosure is only an association relationship describing associated objects and represents existence of three relationships. For example, A and/or B may represent three conditions, i.e., independent existence of A, coexistence of A and B and independent existence of B. In addition, character "/" in the present disclosure usually represents that previous and next associated objects form an "or" relationship.

It should be understood that although the terms first, second, third, etc. may be used to describe certain components in the embodiments of the present disclosure, these components should not be limited only to those terms. These terms are only used to distinguish the components from each other. For example, a first certain component may also be referred to as a second certain component without departing from the scope of the embodiments of the present disclosure. Similarly, a second component may also be referred to as a first certain component.

Depending on the context, the words "if" and "in case of" used herein may be interpreted to mean "when" or "while" or "in response to determining" or "in response to monitoring". Similarly, depending on the context, the phrase "if determined" or "if monitored (conditions or events stated)" can be interpreted as "when determined" or "in response to determination" or "when monitored (stated condition or event)" or "in response to monitor (conditions or events stated)".

In the embodiments of the present disclosure, "substantially equal to", "substantially perpendicular to", "substantially symmetrical", etc. mean that the macroscopic size or relative positional relationship between the two features is extremely close to the relationship described. However, it is clear to those skilled in the art that the positional relationship of an object is difficult to be constrained at a small scale or even a microscopic angle due to the existence of objective factors such as errors and tolerances. Therefore, even if there is a slight error in the size and positional relationship between the two, it does not have a great influence on the realization of the technical effect of the present disclosure.

It should also be noted that the terms "including", "containing" or any other variations thereof are intended to encompass a non-exclusive inclusion, such that the item or system including a series of elements includes not only those elements but also other elements not explicitly listed, or elements that are inherent to such item or system. In the absence of more restrictions, an element defined by the phrase "including one . . . " does not exclude the existence of additional identical elements in the item or system that includes the element.

In the above-described embodiments, although the above method is illustrated and described as a series of acts for the purpose of simplifying the explanation, those skilled in the art will understand and appreciate that these methods are not limited by the order of actions, because in one or more embodiments, some acts may occur in a different order and/or concurrently with other acts from the illustration and description herein or illustrated or described herein, but which may be understood by those skilled in the art.

Those skilled in the art will appreciate that information, signals, and data may be represented using any of a variety of different technologies and techniques. For example, the data, instructions, commands, information, signals, bits (bits), symbols, and chips referenced throughout the above description may be by voltage, current, electromagnetic waves, magnetic fields or magnetic particles, light fields or optical particles, or any combination thereof to represent.

Those skilled in the art will further appreciate that the various illustrative logical blocks, modules, units, circuits, and algorithm steps described in connection with the embodiments disclosed herein may be implemented as electronic hardware, computer software, or the combination of both. To clearly illustrate this interchangeability of hardware and software, various illustrative components, blocks, modules, units, circuits, and steps are described above generally in the form of their functionality. Whether such functionality is implemented as hardware or software depends on the particular application and design constraints imposed on the overall system. The skilled person will be able to implement the described functionality in a different manner for each particular application, but such implementation decisions should not be interpreted as causing a departure from the scope of the invention.

Finally, it should be understood by those skilled in the art that the embodiments of the present disclosure provide numerous technical details in order to provide the reader with a better understanding of the present disclosure. However, even without these technical details and various changes and modifications based on the above embodiments, the technical solutions claimed in the claims of the present disclosure can be substantially realized. Therefore, in practical applications, various changes in the above-described embodiments may be made in the form and details without departing from the spirit and scope of the invention.

In summary, the present disclosure provides: K1, a wiring terminal, including: a conductive member, an elastic piece and a handle;

when the handle is in a first position, the elastic piece resists the conductive member under an acting of an elastic force; and when the handle moves from the first position to a second position along a sliding track, the handle acts on the elastic piece to deform the elastic piece, and separate from the conductive member to form a gap for facilitating a wire drawing or a wire plugging.

K2. The wiring terminal according to K1, when the handle moves to the second position, an end surface of the handle applying an acting force to the elastic piece is a first inclined surface;

an end surface of the elastic piece bearing the acting force is a second inclined surface;

the first inclined surface and the second inclined surface are matching fitted, to resist against an acting of an elastic restoring force and hold the handle at the second position.

K3. The wiring terminal according to K2, the handle conducts a plane sliding along the sliding track on a reference plane; and an angle formed between the first inclined surface and the reference plane is less than 10 degrees.

K4. The wiring terminal according to any one of K1 to K3, further including a housing;

a cavity for maintaining a position of the conductive member and a channel for the handle sliding therein are formed in the housing; and a portion of the handle is disposed within the housing, another portion extends outside the housing through the channel, and a tool jack is provided at an end exposed outside the housing.

K5. The wiring terminal according to K4, where, the housing has a front end surface, and another portion of the handle extends from the front end surface to the outside of the housing;

the front end surface is a third inclined surface; and after a tool is inserted into the tool jack, a high point of the third inclined surface serves as a force applying fulcrum of the tool.

K6. The method according to K5, where, a fourth inclined surface is provided at the high point of the third inclined surface with an angle with the third inclined surface; and after the tool is inserted into the tool jack, the fourth inclined surface is in contact with the tool, to serve as the force applying fulcrum of the tool.

K7. The wiring terminal according to any one of K1 to K3, the conductive member includes two clamping portions, respectively a first clamping portion and a second clamping portion;

the elastic piece includes two resisting portions, respectively a first resisting portion and a second resisting portion;

the elastic piece is located between the two clamping portions, and the first resisting portion and the second resisting portion resist on the first clamping portion and the second clamping portion under the acting of the elastic force of the elastic piece, respectively.

K8. The wiring terminal according to K7, where, the first clamping portion and the second clamping portion are disposed substantially in parallel with each other.

K9. The wiring terminal according to K8, the conductive member further including:

a connecting portion, where, two sides of the connecting portion are respectively connected to the first clamping portion and the second clamping portion;

and where, an angle formed between the connecting portion and the first clamping portion is an obtuse angle, and an angle formed between the connecting portion and the second clamping portion is an acute angle.

K10. The wiring terminal according to K7, where, a position blocking protrusion is formed on the first clamping portion for stopping a sliding of the first resisting portion.

K11. The wiring terminal according to K7, where, a positioning hole is formed on the second clamping portion;

a positioning protrusion is formed on the second resisting portion, when the second resisting portion resists on the second clamping portion, the positioning protrusion is embedded in the positioning hole, to fix a position of the second resisting portion with respect to the second clamping portion.

K12. The wiring terminal according to K7, the elastic piece further including a spring portion connecting the first resisting portion and the second resisting portion, where, the spring portion is substantially formed as "U" shape.

K13. The wiring terminal according to K7, the handle including:

a slope portion, where, a slope surface matching with the first resisting portion is formed on the slope portion, and when the handle moves from the first position to the second position along the sliding track, the slope surface pushes the first resisting portion to separate the first resisting portion from the first clamping portion.

K14. The wiring terminal according to K13, where, a plurality of bends are formed on the first resisting portion from a location contacting the first clamping portion toward a direction away from the first clamping portion, and the slope surface matched with the bends.

K15. The wiring terminal according to K7, the handle further including:

a straight rod portion disposed along the sliding track and connected to the slope portion;

where, a tool jack is provided on one side of the straight rod portion away from the slope portion.

What is claimed is:

1. A wiring terminal, comprising: a conductive member, an elastic piece and a handle; wherein, when the handle is in a first position, the elastic piece resists the conductive member under an acting of an elastic force; and when the handle moves from the first position to a second position along a sliding track, the handle acts on the elastic piece to deform the elastic piece, and separate from the conductive member to form a gap for facilitating a wire drawing or a wire plugging;

wherein when the handle moves to the second position, an end surface of the handle applying an acting force to the elastic piece is a first inclined surface; and an angle formed between the first inclined surface and a reference plane is less than 10 degrees;

further comprising a housing, wherein, a cavity for maintaining a position of the conductive member and a channel for the handle sliding therein are formed in the housing; and a portion of the handle is disposed within the housing, another portion extends outside the housing through the channel, and a tool jack is provided at an end exposed outside the housing;

wherein, the housing has a front end surface, and the another portion of the handle extends from the front end surface to the outside of the housing;

the front end surface is a third inclined surface;

after a tool is inserted into the tool jack, a high point of the third inclined surface serves as a force applying fulcrum of the tool;

a fourth inclined surface is provided at the high point of the third inclined surface with an angle with the third inclined surface; and after the tool is inserted into the tool jack, the fourth inclined surface is in contact with the tool, to serve as the force applying fulcrum of the tool.

2. The wiring terminal according to claim 1, wherein, when the handle moves to the second position, an end surface of the elastic piece bearing the acting force is a second inclined surface with respect to the reference plane;

the first inclined surface and the second inclined surface are matching fitted, to resist against an acting of an elastic restoring force and hold the handle at the second position.

3. The wiring terminal according to claim 2, wherein, the handle conducts sliding along the sliding track on a reference plane.

4. The wiring terminal according to claim 1, wherein, the conductive member comprises two clamping portions, respectively a first clamping portion and a second clamping portion;

the elastic piece comprises two resisting portions, respectively a first resisting portion and a second resisting portion;

the elastic piece is located between the two clamping portions, and the first resisting portion and the second resisting portion resist on the first clamping portion and the second clamping portion under the acting of the elastic force of the elastic piece, respectively.

5. The wiring terminal according to claim 4, wherein, the first clamping portion and the second clamping portion are disposed substantially in parallel with each other.

6. The wiring terminal according to claim 5, the conductive member further comprising:

a connecting portion, wherein, two sides of the connecting portion are respectively connected to the first clamping portion and the second clamping portion;

and wherein, an angle formed between the connecting portion and the first clamping portion is an obtuse angle, and an angle formed between the connecting portion and the second clamping portion is an acute angle.

7. The wiring terminal according to claim 4, wherein, a position blocking protrusion is formed on the first clamping portion for stopping a sliding of the first resisting portion.

8. The wiring terminal according to claim 4, wherein, a positioning hole is formed on the second clamping portion;

a positioning protrusion is formed on the second resisting portion, when the second resisting portion resists on the second clamping portion, the positioning protrusion is embedded in the positioning hole, to fix a position of the second resisting portion with respect to the second clamping portion.

9. The wiring terminal according to claim 4, the elastic piece further comprising a spring portion connecting the first resisting portion and the second resisting portion, wherein, the spring portion is substantially formed as "U" shape.

10. The wiring terminal according to claim 4, the handle comprising:

a slope portion, wherein, a slope surface matching with the first resisting portion is formed on the slope portion, and when the handle moves from the first position to the second position along the sliding track, the slope surface pushes the first resisting portion to separate the first resisting portion from the first clamping portion.

11. The wiring terminal according to claim 10, wherein, a plurality of bends are formed on the first resisting portion from a location contacting the first clamping portion toward a direction away from the first clamping portion, and the slope surface matched with the bends.

12. The wiring terminal according to claim 4, the handle further comprising:

a straight rod portion disposed along the sliding track and connected to a slope portion;

wherein, a tool jack is provided on one side of the straight rod portion away from the slope portion.

* * * * *